United States Patent [19]

Dixon

[11] 4,445,099

[45] Apr. 24, 1984

[54] DIGITAL GYROMAGNETIC PHASE SHIFTER

[75] Inventor: Earl Dixon, Voorhees, N.J.

[73] Assignee: RCA Corporation, New York, N.Y.

[21] Appl. No.: 323,470

[22] Filed: Nov. 20, 1981

[51] Int. Cl.[3] ..... H01P 1/195

[52] U.S. Cl. ..... 333/24.1; 307/101; 307/314; 333/158

[58] Field of Search ..... 333/24.1, 158; 307/314, 307/101; 328/56

[56] References Cited

U.S. PATENT DOCUMENTS

| | | | |
|---|---|---|---|
| 3,274,521 | 9/1966 | Nourse . | |
| 3,277,401 | 10/1966 | Stern . | |
| 3,290,622 | 12/1966 | Hair . | |
| 3,316,506 | 4/1967 | Whicker et al. | 333/24.1 |
| 3,425,003 | 1/1969 | Mohr | 333/24.1 X |
| 3,471,809 | 10/1969 | Parks et al. . | |
| 3,519,956 | 7/1970 | Hai et al. . | |
| 3,539,950 | 11/1970 | Freibergs . | |
| 3,699,584 | 10/1972 | Hrivnak et al. . | |
| 3,721,922 | 3/1973 | Boensel | 333/24.1 |
| 3,747,098 | 7/1973 | Kirkpatrick et al. . | |
| 3,754,274 | 8/1973 | Auger . | |
| 3,835,397 | 9/1974 | D'Antonio . | |
| 3,851,281 | 11/1974 | Hanfling . | |
| 3,988,686 | 10/1976 | Beall et al. . | |

OTHER PUBLICATIONS

"Microwave Ferrite Devices-1968", Microwave Journal, vol. 11, #4, Apr. 1968 by J. E. Pippin.

"The Partially Latched Twin-Slab Ferrite Phase Shifter in Rectangular Waveguide and Electronic Driving Methods", 1969 European Microwave Conf., London, England, (Sep. 8-12, 1969) by R. B. Bell, J. T. Zakrzewski and D. R. Hodge.

"A Single Bit Latching Reciprocal Ferrite Phase Shifter", Microwaves, pp. 46-50, Mar. 1970, by Joe K. Parks and Robert Ausband.

*Primary Examiner*—Paul L. Gensler

*Attorney, Agent, or Firm*—Joseph S. Tripoli; Robert L. Troike; Robert Ochis

[57] ABSTRACT

The phase shift resolution provided by an N element digital gyromagnetic phase shifter is increased and the number of obtainable phase states is increased by $2^N-1$ to $2^{N+1}-1$ by modification of the control and driver circuitry to selectively set elements to a half-maximum phase shift condition in addition to the known zero phase shift and maximum phase shift conditions.

7 Claims, 5 Drawing Figures

Figure 1:
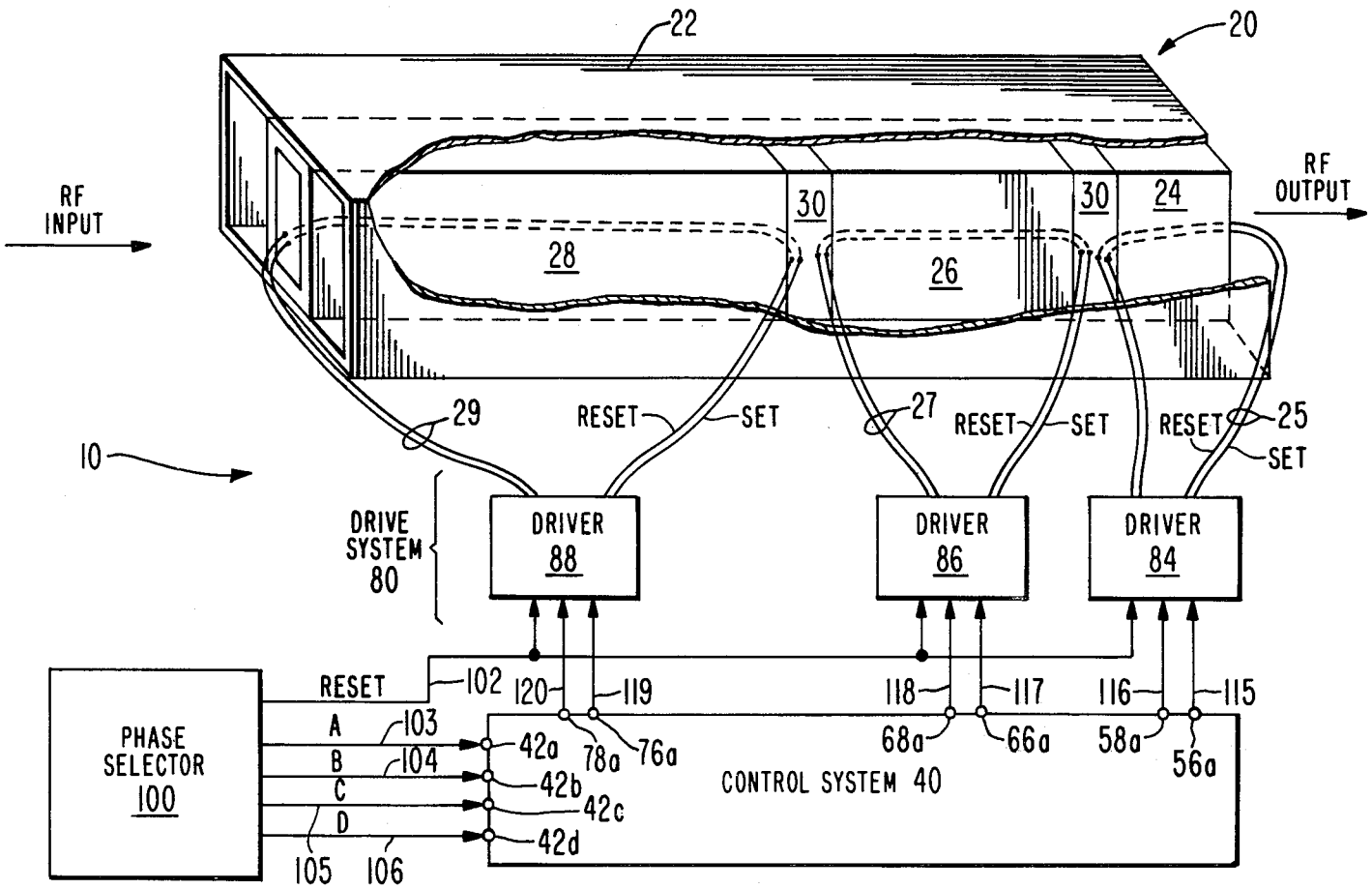

| I | II | III | IV | | |
|---|---|---|---|---|---|
| PHASE SETTING NUMBER | PHASE COMMAND BIT: A B C D | PHASE SHIFT SPECIFIED | TOROID STATES PRODUCED TOROID: 118 (180°) | 116 (90°) | 114 (45°) |
| 0 | 0 0 0 0 | 0° | 0 | 0 | 0 |
| 1 | 0 0 0 1 | 22.5° | 0 | 0 | 1/2 |
| 2 | 0 0 1 0 | 45° | 0 | 0 | 1 |
| 3 | 0 0 1 1 | 67.5° | 0 | 1/2 | 1/2 |
| 4 | 0 1 0 0 | 90° | 0 | 1 | 0 |
| 5 | 0 1 0 1 | 112.5° | 0 | 1 | 1/2 |
| 6 | 0 1 1 0 | 135° | 0 | 1 | 1 |
| 7 | 0 1 1 1 | 157.5° | 1/2 | 1/2 | 1/2 |
| 8 | 1 0 0 0 | 180° | 1 | 0 | 0 |
| 9 | 1 0 0 1 | 202.5° | 1 | 0 | 1/2 |
| 10 | 1 0 1 0 | 225° | 1 | 0 | 1 |
| 11 | 1 0 1 1 | 247.5° | 1 | 1/2 | 1/2 |
| 12 | 1 1 0 0 | 270° | 1 | 1 | 0 |
| 13 | 1 1 0 1 | 292.5° | 1 | 1 | 1/2 |
| 14 | 1 1 1 0 | 315° | 1 | 1 | 1 |
| 15 | 1 1 1 1 | 337.5° | --- | --- | --- |

*Fig. 5*

DIGITAL GYROMAGNETIC PHASE SHIFTER

This invention relates to the field of radio frequency (RF) gyromagnetic phase shifters and more particularly to digital gyromagnetic phase shifters.

Gyromagnetic phase shifters are phase shifters which utilize the magnetic properties of a gyromagnetic material which when a D. C. magnetic field is present shifts the phase of an RF electromagnetic wave propagating through the gyromagnetic material. Gyromagnetic material is a general term intended to encompass ferrimagnetic materials, ferromagnetic materials and any other materials which exhibit the same effect in the presence of a D. C. magnetic field as discussed in various texts such as "Microwave Ferrites and Ferrimagnetics" by B. Lax and K. J. Button, McGraw-Hill, 1962. Ferrites and garnets of the types commonly used in phase shifters are specific classes of gyromagnetic materials.

A digital gyromagnetic waveguide phase shifter has a plurality of gyromagnetic toroids disposed in lengthwise succession within a waveguide. Each toroid has its own bias wire loop and driver. The driver provides a current pulse on the bias wire as needed to saturate (latch) the magnetic remanence of that toroid in either of two directions with a first direction for each toroid producing 0° phase shift and a second direction for each toroid producing its maximum phase shift which is directly proportional to its length. The electrical lengths of the toroids are usually binarily related $(\frac{1}{2}^n)360°$ i.e. $(\frac{1}{2}^1, \frac{1}{2}^2, \ldots \frac{1}{2}^n)\times 360°$ and selected to provide successive toroids with maximum phase shifts of 180°, 90°, 45°, . . . to the desired resolution of the system. A three toroid phase shifter can provide eight different phase shifts from 0° to 360° in increments of 45°, (0°, 45°, 90°, 135°, 180°, 225°, 270°, 315°) with 0° being equivalent to 360° in a steady state. A 3-bit binary input phase command is used to control a three-toroid phase shifter with each data bit directly associated with and controlling the setting of the remanence of a single toroid—a "0" bit value sets a 0° phase shift and a "1" bit value sets a maximum phase shift. To increase this phase shifter's resolution by a factor of two and provide 16 different phase shifts in 22½° increments, a 4-bit binary input phase command is used and an additional gyromagnetic toroid and its driver are added to the phase shifter. This increases the power required to drive the phase shifter, the cost of its driver system and the cost and weight of its gyromagnetic material. All these considerations are important in systems such as phased array antennas which utilize a large number of phase shifters.

A digital gyromagnetic waveguide phase shifter having increased resolution without requiring increased gyromagnetic material or drivers is needed.

In accordance with the preferred embodiment of this invention, the problems of the prior art are overcome by providing a digital gyromagnetic waveguide phase shifter with drivers which are capable of setting the remanence of each gyromagnetic element to an intermediate condition as well as to the two saturated states known in the digital phase shifter prior art and by providing control circuitry responsive to increased resolution phase commands for selecting which of the three states to place a given gyromagnetic element in.

Figure 2:
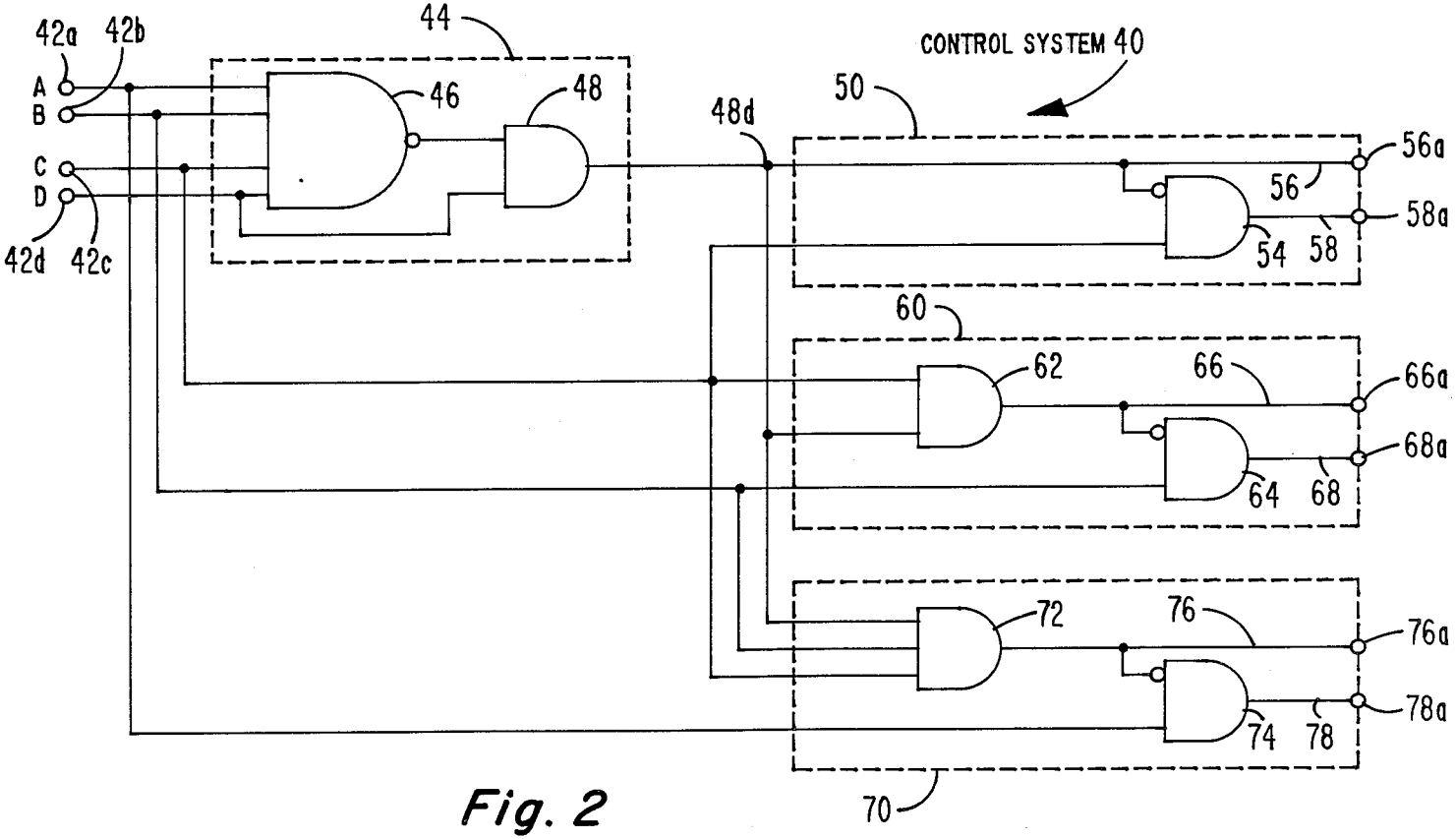
Figure 3:
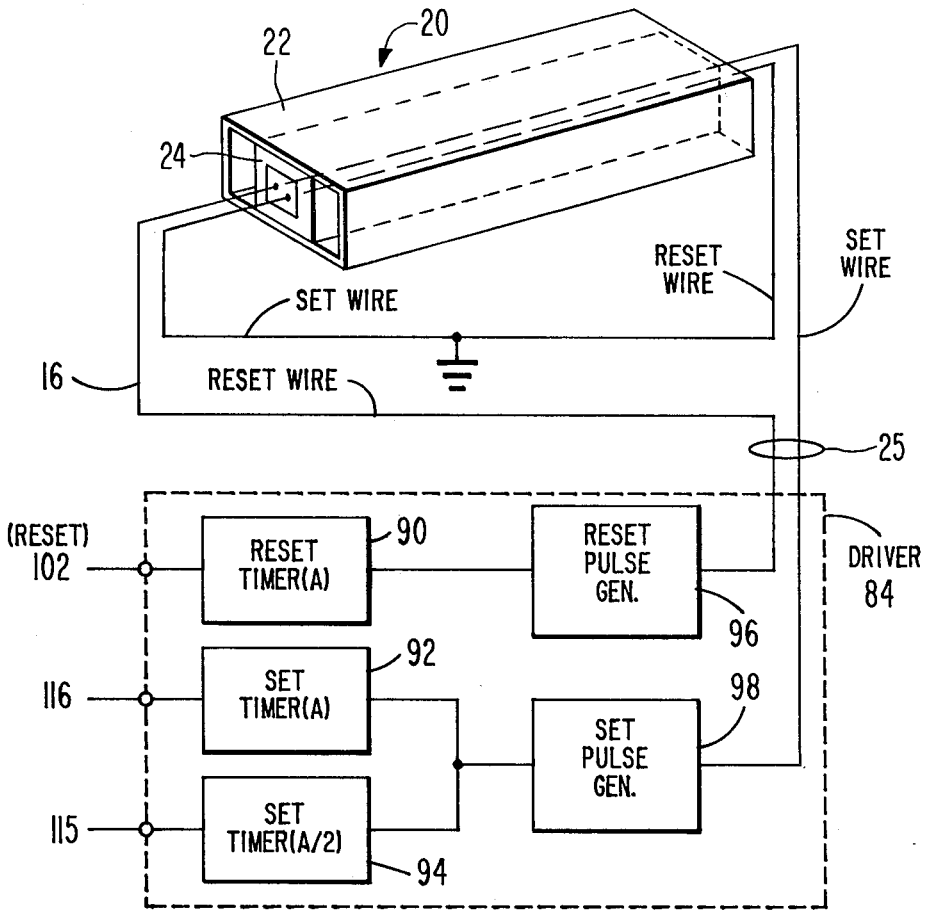
Figure 4:
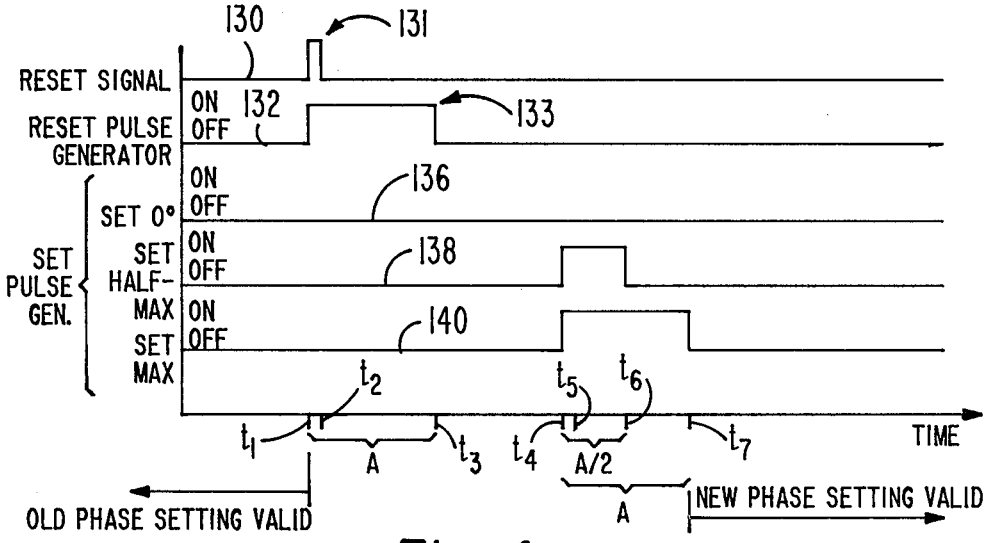

In the drawings:

FIG. 1 is a combined block diagram and sketch of a three toroid digital gyromagnetic waveguide phase shifter in accordance with the invention, FIG. 2 is a logic diagram of a control system for providing the requisite control signals to the drivers, FIG. 3 is a block diagram of a driver coupled through one toroid of the phase shifter of FIG. 1, FIG. 4 is a timing diagram illustrating the sequence of events which occurs during the setting of a new phase.

FIG. 5 is a table useful for understanding the operation of the FIG. 1 system with 4-bit commands.

The invention will be described in connection with a digital gyromagnetic phase shifter having three elements of gyromagnetic material but is applicable to those having either more or fewer elements. A gyromagnetic waveguide phase shifter 10 in FIG. 1 comprises an RF transmission structure 20, a phase shifter control system 40 and a phase shifter drive system 80. A phase selector 100 provides phase shift commands to phase shifter control system 40 and thus selects the phase shift to be provided by phase shifter 10. Transmission structure 20 comprises a rectangular waveguide 22, a series of three toroids 24, 26 and 28 of gyromagnetic material centered between the narrow walls and in contact with both broad walls of the waveguide 22 and a pair of drive wires 25, 27 and 29 for each toroid (24, 26 and 28, respectively). Each pair of drive wires is composed of a set wire and a reset wire. The toroids 24, 26 and 28 are separated by dielectric spacers 30 in order that the toroids may have their magnetic remanence set independently of each other by drive currents on their drive wires. Toroids 24, 26 and 28 are sized to provide maximum phase shifts of 45°, 90° and 180°, respectively.

Drive system 80 comprises a separate driver 84, 86 and 88 connected to control the magnetization of each of the toroids (24, 26 and 28, respectively) by passing a magnetizing current pulse lengthwise through the core of that toroid on the set or reset wire of the associated drive wire pairs (25, 27 and 29 respectively).

Each time phase shift selector 100 selects a new phase shift setting, it generates a reset signal which is transmitted directly to each of the drivers 84, 86 and 88. In response to this reset signal, each driver generates a reset current pulse on the reset wire of its associated drive wire pair (25, 27 or 29). This resets the toroid to its 0° phase shift condition. A 4-bit (bits A, B, C and D) phase shift control signal is then provided to input terminals 42*a* through 42*d* of control system 40 over four leads 103 thru 106 by phase shift selector 100 where bit A on lead 103 is the most significant bit, bit B on lead 104 is the next most significant bit, bit D on lead 106 is the least significant bit, and bit C on lead 105 is next least significant bit. In response, control system 40 produces at terminals 56*a* and 58*a*, a 2-bit control signal for driver 84. Similarly system 40 provides 2-bit control signals for driver 86 via terminals 66*a* and 68*a* and for driver 88 via terminals 76*a* and 78*a*. Thus, system 40 receives a multi-bit (4-bit) phase command and produces therefrom a number of multi-bit (2-bit) phase control signals. Each driver 84, 86, 88 responds to its 2-bit control signal provided via leads 115 and 116, 117 and 118, and 119 and 120, respectively by generating and applying to its set wire a pulse of (1) a given volt-time duration to saturate the associated toroid in one direction, (2) a volt-time duration of one half the given volt-time duration, to place the toroid in an intermediate condition or (3) no pulse at all to leave the toroid in its 0° phase shift condition. The given volt-time duration depends on the length of the toroid since a larger volt-time integral is needed to saturate a larger quantity of gyromagnetic material. Thus, for fixed voltage amplitude pulses, the given time duration for a 180° toroid is twice that for a 90° toroid.

The 337.5° phase shift which a prior art 4-bit, 4 toroid digital phase shifter provides in response to a 1111 phase command cannot be provided by the phase shifter system of FIG. 1. Consequently, the use of the 1111 phase command is forbidden or it is defined as the same as a 1110 command and a 315° phase shift is provided in response to it.

FIG. 2 is an exemplary control system 40 which responds to the 4-bit phase commands (A, B, C and D) at input terminals 42*a* through 42*d* to produce the three separate drive control signals for the three drivers 84, 86 and 88 in FIG. 1 at terminals 56*a*, 58*a*; 66*a*, 68*a*; and 76*a* and 78*a*, respectively. To prevent malfunction in the presence of a 1111 command, a command converter 44 receives the input command and, if it is 1111, converts it to a 1110 operative command prior to processing the command. The command converter leaves all commands other than 1111 unchanged. The command converter 44 employs a four high NAND gate 46 to detect a 1111 command or all 1's at terminals 42*a* thru 42*d* and an AND gate 48 to force the final or D-bit at terminal 42*d* to 0 at point 48*d* upon detection of a 1111 command. AND gate 48 passes the D-bit unchanged to point 48*d* whenever the received command is not 1111.

The decoding portion of control system 40 which follows command converter 44 is structured as a plurality of individual driver control networks 50, 60 and 70, one for each driver (84, 86 and 88, respectively). Network 70 is associated with the most significant bit (A) of the phase command and controls driver 88 which, in turn, controls the longest toroid 28. Network 60 is associated with the next most significant bit (B) of the phase command and controls driver 86 which, in turn controls the next longest toroid 26. Control network 50 is associated with the next-to-least-significant bit (C) of the phase command and controls driver 84 which, in turn, controls the shortest toroid 24. The least significant bit (D) does not have an associated control network since there is no corresponding toroid or driver.

Hereinafter references are to the operative phase command, that is phase commands ranging from 0000 to 1110 and excluding 1111 since use of the 1111 command is forbidden and command converter 44 converts any 1111 commands to 1110 commands prior to the command being applied to the decoding portions of control system 40.

Each of the networks 50, 60 and 70 responds to all less siqnificant bits of the operative phase command being 1's by providing a control signal for setting its associated toroid to the intermediate condition (half maximum phase shift). The networks respond to at least one of the less significant bits of the operative phase command being a 0 by producing a control signal which places (leaves) the toroid in the 0° phase shift condition when the associated bit of the phase command is a 0 and by providing a control signal which places the toroid in the maximum phase shift condition when the associated bit of the phase command is a 1.

In network 50 a high level (logic 1) is present on output line 56 whenever the D bit (the least significant bit) of the operative phase command (at point 48*d* after phase command converter 44) is a 1. This is the condition under which it is desired to set the shortest toroid 24 to its intermediate state to produce a phase shift of 22½°. A logic gate 54 in the form of a two input AND gate having one of its inputs inverting has its inverting input coupled to line 56 and its non-inverting input coupled to respond to the C-bit of the phase command from terminal 42*c*. The C-bit's value is applied to output line 58 and terminal 58*a* unless line 56 is high.

If line 56 is high, then output line 58 and the output level at terminal 58*a* are held low. Output terminals 56*a* and 58*a* are connected to driver 84 by its control signal input lines 115 and 116, respectively. The output levels at terminals 56*a* and 58*a* together may have any one of three states. Both are held at a low output level when toroid 24 is to be set to (left in the) 0° phase shift condition in which the reset signal placed it (a first control signal). A high signal level is imposed on line 58 and a low signal is imposed on line 56 when toroid 24 is to be set to its maximum phase shift condition (45°) (a second control signal). A low signal level is imposed on line 58 and a high signal level is imposed on line 56 when the toroid 24 is to be set to its intermediate phase shift condition (22½°) (a third control signal). The condition of both lines being high will not occur because of the inverting connection of line 56 to the AND gate 54.

In control network 60 AND gate 62 provides a high output whenever the C bit and the D bit (at point 48*d*) of the operative phase command are 1's. This is the condition under which it is desired to set the second toroid 26 to its intermediate condition. AND gate 64 has an inverting input coupled to the output of AND gate 62 and a non-inverting input coupled to receive the B-bit of the phase command from terminal 42*b* to produce the control signals at terminals 66*a* and 68*a* for driver 86 in the same manner as is done by AND gate 54 for driver 84.

In control Network 70 AND gate 72 provides a high output whenever the B, C and D bits (at terminals 42*b*, 42*c* and point 48*d*, respectively) of the operative phase command are 1's. This is the condition under which it is desired to set the longest toroid 28 to its intermediate condition. AND gate 74 has an inverting input terminal coupled to output line 76 and a non-inverting input terminal coupled to receive the A-bit of the phase command to create the control signals at terminals 76*a* and 78*a* for driver 88 in the same manner as is done by AND gate 54 for driver 84.

A direct current pulse driver 84 for use in this invention is illustrated in FIG. 3 and comprises a reset timer 90, two set timers 92 and 94, a controllable reset d.c. pulse generator 96 and a controllable set d.c. pulse generator 98. Each of the timers 90, 92 and 94 is triggered by a low signal level to a high signal level transition at its control input. The reset line 102 from phase shift selector 100 is connected to the control input of reset timer 90. Lines 115 and 116 (coupled to terminals 56*a* and 58*a* respectively) from phase shifter control 40 are connected to the control inputs of set timers 94 and 92, respectively. The output of reset timer 90 is connected to the control input of reset pulse generator 96. Set timers 92 and 94 both have their outputs connected to the set pulse generator 98. Reset timer 90 and set timer 92 in response to a low level to high level transition as occurs upon the appearance of a high level (logic 1) control signal in place of a low level (logic 0) control signal energize their respective pulse generators of a given amplitude for a period of time A—a pulse duration which can switch toroid 24 from magnetically saturated in one direction to magnetically saturated in the other direction. Set timer 94 in response to a similar transition energizes set pulse generator 98 with the same amplitude for half the saturated time period or time A/2. This provides a pulse duration which can switch toroid 24 from its reset (0° phase shift) condition (saturated in a first direction) to an intermediate condition which approaches zero remanence (but is not zero remanence since multiple cycles of decreasing amplitude would be needed to completely demagnetize the gyromagnetic material). This remanence level provides a phase shift which is one half (22½°) of the amount (45°) provided when toroid 24 is saturated in the maximum phase shift direction.

The current drivers 86 and 88 are identical to current driver 84 except for the time durations. The longer toroids require proportionately more time to saturate in either direction or to produce the intermediate valve.

The time sequence of the events which occur when a new phase shift is to be set is illustrated in FIG. 4. At time $t_1$ prior to setting a new phase shift, a reset pulse 131 which is a high level on the reset line and which is illustrated in waveform 130 in FIG. 4 is provided by phase shift selector 100 and activates timer 90 to generate a pulse 133 from reset pulse generator 96 which lasts a period of time A (waveform 132 in FIG. 4). A magnetizing current passes through the toroid in a clockwise direction on wire 16 in FIG. 3 for the duration of the pulse 133. This saturates the toroid in its 0° phase shift state. The duration A of the reset pulse which is required to assure that the toroid is reset to its zero phase shift condition is directly proportional to the toroid's length. At time $t_1$, if not done previously, the phase selection outputs from phase selector 100 are set to 0000 to clear the driver control signals from control system 40.

At a time $t_4$ (after the reset pulses for all toroids have terminated) phase shift selector 100 applies the new phase selection signal to the input 42 of control system 40. That signal is decoded by control system 40 which applies the appropriate control signal to each driver. Where a 0° phase shift is called for from toroid 24 a low level is present at terminals 56*a* and 58*a* and the set pulse generator 98 in driver 84 is not turned on by either of the set timers 92 or 94 as is illustrated by waveform 136 in FIG. 4. Where a maximum phase shift is called for from toroid 24 a low signal level is present at terminal 56*a* and a high signal level is present at terminal 58*a*. The high signal level at terminal 58*a* activates set timer 92 which energizes set pulse generator 98 for time period A (waveform 140 in FIG. 4) to pass a magnetizing current through the toroid in a counterclockwise direction on the set wire. This saturates the remanence of the toroid 24 in the maximum phase shift condition. Where half-maximum phase shift is called for from toroid 24 a high signal level is present at terminal 56*a* and a low signal level is present at terminal 58*a*. The high signal level at terminal 56*a* activates set timer 94 which turns on set pulse generator 98 for a period of time A/2 (waveform 138 in FIG. 4) to pass a magnetizing current through toroid 24 in a counter clockwise direction on the set wire to drive the toroid's remanence to the intermediate value which will produce a half-maximum phase shift. This leaves toroid 24 in an unsaturated state which approaches zero remanence.

Once each of the timers which is to be activated by this new phase shift command has been triggered, the phase selection command can be reset to all zeros (without generating a reset pulse on line 102) in preparation for the next phase shift command. This resetting of the phase shift command to all zeros is done at the latest at time $t_1$ of the next phase shift command cycle. If operation with pulse phase selection commands is desired, then proper operation will be obtained as long as the phase selection command pulses are of sufficient duration to assure proper triggering of all selected timers.

FIG. 5 is a table illustrating the response of phase shifter 10 to 4-bit phase commands and the manner in which the corresponding phases are provided by the remanence states established for the toroids. Column I specifies the phase setting number for each row of entries in Columns I—IV. In Column II is the corresponding 4-bit phase command which is the binary code for the phase setting number. The four bit positions A (most significant) B, C and D (least significant) are indicated at the top of this column. Column III is the phase shift specified by the command in Columns I & II and Column IV indicates the toroid states the command in Column II induces in order to produce the phase shift in Column III. In Column IV a "0" indicates a zero phase shift setting of the remanence, a "1" indicates a maximum phase shift setting of the remanence and a "½" indicates an intermediate setting of the remanence which induces the intermediate phase shift. The portions of the commands shown in bold face in Column II along with the bold face phase shift values in Column III and the bold face toroid states in Column IV are those of a prior art 3 toroid (3-bit) gyromagnetic waveguide digital phase shifter. (These correspond to the phase settings 0–7 in such a prior art three toroid system.) The additional phase shifts shown in light face type are provided by setting one or more of the toroids to their intermediate remanence state and result from the presence of a 1 as the D bit in the (added) fourth bit position of the increased resolution phase command. The odd numbered phase states 1–13 are those for which the shortest toroid (24) is set to its intermediate state as described above. The phase states 3, 7 and 11 are those for which the medium length toroid (26) is also set to its intermediate state as described above and the phase state 7 is the one for which the longest toroid (28) is also set to its intermediate state as described above.

The phase setting 15, its command 1111 and its phase shift of 337.5° are shown in phantom without toroid states because this phase shift condition is not obtainable by this invention utilizing only three toroids sized for maximum phase shifts of 45°, 90° and 180°. Three possibilities for handling a 1111 phase command are (1) to forbid its provision to control system 40; (2) to have control system 40 react by providing the phase shift 1110 (315°) in response to the command 1111; or (3) to have the control system react by providing the phase shift 0000 (0°). Each of the latter two choices provides a phase shift which is 22½° away from the 337.5° phase shift produced in a prior art 4-toroid (4-bit) phase shifter in response to the command 1111. As has been described, in the illustrated preferred embodiment choices (1) and (2) have been made.

The enhanced three toroid digital phase shifter 10 in accordance with this invention provides the same eight phase shift increments as prior art three-toroid phase shifters and provides seven additional phase states only obtainable in prior art digital phase shifters through use of four drivers and 4 toroids (180°, 90°, 45° and 22½°). The 337.5° phase shift increment is the only phase shift increment that a prior art four-toroid phase shifter would provide which this enhanced three-toroid phase shifter cannot provide. Thus, this invention provides a substantial increase in the resolution of a digital gyromagnetic phase shifter without modification of its magnetic structure and waveguide or an increase in the number of its drivers.

It is known in the phased array antenna art, that the inability to produce a particular phase shift value has only a minor effect on main beam shape and directionality but does produce a significant increase in side lobe levels. Thus, the use of this improved phase shifter in a given system gives its main improvement in reduced side lobe levels as compared to a prior art phase shifter having the same number of toroids and is applicable to such a system independent of the number of toroids used. Cost and weight versus performance trade off's in antenna design make this enhanced phase shifter an attractive choice because of its substantially increased performance without a significant increase in weight.

What is claimed is:

1. A digital gyromagnetic waveguide phase shifter comprising:

a waveguide;

N gyromagnetic toroid elements of substantially binarily related lengths disposed serially along and within said waveguide where N is a positive integer greater than 1;

a separate biasing loop passing through each of said toroid elements for, in response to a current applied thereto, controlling the magnetization of the element and hence the phase shift produced by the element;

N drivers, one coupled to each biasing loop for controlling the associated element's magnetic field bias to control the phase shift induced by that element;

each of said drivers responsive to a first control signal for providing a driver current output that magnetically saturates its associated element in a first direction to provide a 0° phase shift, responsive to a second control signal to provide a driver output that magnetically saturates its associated element in a second direction to provide an X° phase shift and responsive to a third control signal to provide a driver output that places said element in an intermediate magnetic condition to provide a phase shift of (X/2)°, where X for each of the elements is directly related to its length; and means for selectively providing said first, second and third control signals to said drivers including:

means to reset said elements to their zero phase shift condition, and control means connected to receive N+1 bit phase selection commands and to provide N separate driver control outputs, one for each driver.

2. The phase shifter recited in claim 1, wherein:

said control means includes an individual control network associated with each driver, each said control network having a specific bit of said phase selection command associated with it;

each said control network responsive to all bits of said phase selection command which are less significant than its associated bit being one logic level for providing said third control signal to said driver; and each said control network responsive to at least one of the bits of said phase selection command which is less significant than its associated bit being a second logic level for providing:

said first control signal to said driver when said associated bit is a 0; and said second control signal to said driver when said associated bit is a 1.

3. A digital gyromagnetic waveguide phase shifter comprising:

a waveguide;

a plurality of gyromagnetic toroid elements of substantially binarily related lengths disposed serially along and within said waveguide;

a separate biasing loop passing through each of said toroid elements for, in response to a current applied thereto, controlling the magnetization of the element and hence the phase shift produced by the element;

a plurality of drivers, one coupled to each biasing loop for controlling the associated element's magnetic field bias to control the phase shift induced by that element;

each of said drivers responsive to a first control signal for providing a driver current output that magnetically saturates its associated element in a first direction to provide a 0° phase shift, responsive to a second control signal to provide a driver output that magnetically saturates its associated element in a second direction to provide an X° phase shift and responsive to a third control signal to provide a driver output that places said element in an intermediate magnetic condition to provide a phase shift of (X/2)°, where X for each of the elements is directly related to its length; and means for selectively providing said first, second and third control signals to said drivers including:

means for receiving a multi-bit phase selection command, and means for decoding said multi-bit phase command into a plurality of multi-bit control signals, one for each of said drivers.

4. The phase shifter recited in claim 3 wherein:

said means for decoding provides a 2-bit control signal to each of said drivers.

5. The phase shifter recited in claim 4 wherein:

said drivers are responsive to a reset signal to provide a reset current to said biasing loop to reset said toroid to said first magnetically saturated condition in which said toroid provides a 0° phase shift; and said drivers are responsive to a 2 bit set signal to provide;

(a) in response to a first value, no set current to said biasing loop to leave said toroid in a 0° phase shift condition, (b) in response to a second value, a current pulse of a first duration to said biasing loop to set said toroid to a maximum phase shift condition, and (c) in response to a third value, a current pulse of one-half of said first duration to said biasing loop to set said toroid to said intermediate magnetic condition which provides a half maximum phase shift.

6. In a gyromagnetic phase shifter having N phase shifting elements, the improvement comprising:

means responsive to N+1 bit phase selection commands and providing N outputs each associated with one of said N elements for controlling the setting of that element to one of three different states, a zero phase shift state, a maximum phase shift state and an intermediate phase shift state whereby the resolution of said phase shifter is increased.

7. The improvement recited in claim 6 wherein said intermediate phase shift state is a half-maximum phase shift.

* * * * *